United States Patent [19]

Breen et al.

[11] Patent Number: 4,932,337

[45] Date of Patent: Jun. 12, 1990

[54] METHOD TO IMPROVE THE PERFORMANCE OF LOW-NOX BURNERS OPERATING ON DIFFICULT TO STABILIZE COALS

[75] Inventors: Bernard P. Breen, Laguna Beach; John H. Pohl, Mission Viejo; Howard B. Lange, San Clemente, all of Calif.

[73] Assignee: Consolidated Natural Gas Service Company, Inc., Cleveland, Ohio

[21] Appl. No.: 236,608

[22] Filed: Aug. 25, 1988

[51] Int. Cl.[5] ..... F23D 1/00

[52] U.S. Cl. ..... 110/347; 110/260; 110/262

[58] Field of Search ..... 110/347, 260, 261, 262

[56] References Cited

U.S. PATENT DOCUMENTS 4,597,342 7/1986 Green et al. ..... 110/261 X 4,790,743 12/1988 Leikert et al. ..... 110/261 X

FOREIGN PATENT DOCUMENTS 0280568 8/1988 European Pat. Off. ..... 110/261

*Primary Examiner*—Edward G. Favors

*Attorney, Agent, or Firm*—Buchanan Ingersoll; Lynn J. Alstadt

[57] ABSTRACT

A method is disclosed which overcomes the problems which tend to occur in application low-NOx burners to coals in which the volatile matter is low in heat content. A gaseous or volatile liquid fuel is introduced into the ignition zone and/or the primary flame immediately downstream of the burner. This fuel will have the same effect as increased quality and quantity of the volatile content of the coal.

18 Claims, 2 Drawing Sheets

METHOD TO IMPROVE THE PERFORMANCE OF LOW-NOX BURNERS OPERATING ON DIFFICULT TO STABILIZE COALS

BACKGROUND OF THE INVENTION

1. Field of the Invention

The present invention relates to a method of reducing NOx emissions from coal fired furnaces. More particularly it relates to the reduction of NOx emissions from the combustion of pulverized coal having volatile matter which is low in heat content.

2. Description of the Prior Art

Nitric oxide (NO) is an air pollutant. In many areas of the United States, as well as other countries, methods are sought to reduce its concentration level in flue gases emitted from coal-fired boilers. In the combustion of fuel in the boilers, one problem is the production of nitric oxide due to oxidation of both fuel-bound nitrogen and nitrogen entering with the combustion air.

A portion of the nitric oxide produced by a burner oxidizes to form nitrogen dioxide ($NO_2$) downstream of the combustion process, as well as in the atmosphere. Consequently, production of nitric oxide at the burner results in both NO and $NO_2$, commonly called NOx, being emitted into the atmosphere.

This invention addresses two concerns of pulverized coal combustion:

(1) further reduction of NOx produced by commercially available low-NOx burners, and (2) maintenance of a stable flame on these burners so that coals having a wider range heat of contents can be successfully and stably burned.

In pulverized coal combustion as practiced in boilers, kilns, and other combustion devices, the pulverized coal is generally conveyed to the burners by the "primary" air stream. The primary air in many cases is preheated, dries the coal and carries the coal out of the pulverizer. The ratio of primary air to coal is typically between 1 and 3 on a weight basis to best accomplish these functions.

As the coal and primary air stream enters the furnace via the burner, heat from downstream combustion is transported by recirculated gases and radiation back to the incoming coal particles causing them to heat and devolatilize. The volatiles that are released from the coal particles mix with the primary air, and the temperature and fuel/air ratio of the mixture eventually become sufficient for ignition to occur. The ignition stability of the burner thus depends mainly upon this process of heat transfer from the primary flame zone, devolatilization of the coal, and ignition of the coal volatiles-primary air mixture and/or the solid coal.

As mentioned above, the region immediately following the ignition zone of the burner, in which the coal devolatilization is completed and the volatiles are burned, is generally termed the "primary flame" zone. In this zone, the bulk of the combustion air, i.e., the "secondary" air which is admitted separately from the primary air, mixes with the fuel and burns. The primary flame zone is followed by a char burnout zone in which the devolatilized coal particles are burned in an atmosphere of typically 15% to 25% excess air (i.e., 3% to 5% $O_2$).

Recent experience has shown that coals in which the volatile matter is low in heat content are more difficult to ignite and burn in flames. Such coals do not release heat rapidly enough to establish a stable ignition zone.

Another phenomenon that occurs with coals that are only marginally adequate in quality and extent of volatiles content is that of flame lift-off. In this case, a quasi-stable ignition zone is established, but at a relatively large distance from the burner due to the longer coal particle residence time required to produce the heat required for ignition.

In testing the ignition stabilities of a range of coals to deliberately explore the effect of volatiles content on ignition stability, it was learned that coals with less than approximately 3400 Btu/lb volatile heat content, $HHV_{vol}$, tend to have unstable ignition characteristics. The parameter $HHV_{vol}$ can be calculated from:

$$HHV_{vol} = HHV_{coal} - (1 - VM)HHV_{char} \quad (1)$$

where $HHV_{vol}$ = higher heating value of volatiles, Btu/lb coal $HHV_{coal}$ = higher heating value of coal, Btu/lb coal VM = volatile matter in coal, percentage $HHV_{char}$ = higher heating value of char, Btu/lb.

Formation of NO occurs in both the primary flame zone and the char burnout zone. In the primary flame, NO forms primarily from oxidation of volatilized organic nitrogen compounds. In the char burnout zone, NO forms primarily by oxidation of organic nitrogen compounds in the char, and to a minor extent by oxidation of nitrogen in the air. These three NO formation mechanisms can be summarized as follows:

$$\text{Primary Flame: Volatile N} \longrightarrow \text{NO} \quad (2)$$

$$N_2 \longrightarrow \text{NO} \quad (3)$$

$$\text{Char Burnout: Char N} \longrightarrow \text{NO} \quad (4)$$

Work by Pohl and Sarofim, reported in "Devolatilization and Oxidation of Coal Nitrogen," showed that a major fraction (approximately 70%) of NO formed in pulverized coal combustion is due to oxidation of volatile fuel nitrogen, i.e., mechanism 2 above.

One method that is commonly applied to reduce NO formation in pulverized coal firing is the use of low-NOx burners. Low-NOx burners reduce NO formation by delaying the mixing of secondary air into the primary flame. Delay of secondary air mixing produces a lower air/fuel ratio (i.e., air/volatiles ratio) in the primary flame, thus reducing the amount of NO formed from volatile fuel nitrogen. The fact that lowering the air/fuel ratio in the primary flame reduces NO formation is demonstrated by the work of Kawamura and Frey, "Current Developments in Low-Nox Firing Systems," in which the primary air was lowered, causing a reduction in NO formation.

The low-NOx burner principle is less effective on coals of lower volatiles contents and lower heating value of the volatile matter due to the greater difficulty of lowering the air/fuel ratio in the primary flame while preserving ignition stability. This problem in applying low-NOx burners to coals of lower volatiles contents has three components:

(1) As the volatiles content of the coal is reduced, the effective air/fuel ratio in the primary flame (i.e., air/volatiles ratio) increases, causing an increase in NO formation. Although the primary air could, in principle, be decreased for a lower-volatile coal, there is in reality a practical minimum necessary to preserve the transport and drying functions of the primary air.

(2) At sufficiently low heat content of the volatile matter in the coal, flame lift off will occur. This permits mixing of secondary air into the flame prior to complete devolatilization due to the displacement of the ignition zone farther from the burner and thus further increases NO formation. The increase of NO formation due to a lifted flame was documented by Heap et. al. in "Burner Design Principles for Minimum NOx Emissions."

(3) At a still lower heat content of the volatile matter, ignition will become too unstable for practical operation of the burner. This problem is not specific to low-NOx burners. Therefore, the invention is extended to include conventional pulverized coal burners.

SUMMARY OF THE INVENTION

The invention disclosed herein is intended to overcome any or all of the problems listed above which tend to occur in application low-NOx burners to coals in which the volatile matter is low in heat content. We introduce a gaseous or volatile liquid fuel into the ignition zone and/or the primary flame immediately downstream of the burner. This fuel will have the same effect as increased quality and quantity of the volatile content of the coal and thus will overcome all of the above three problems.

These and other advantages and features of the present invention will be more fully understood on reference to the presently preferred embodiments thereof and to the appended drawings.

DESCRIPTION OF THE PREFERRED EMBODIMENTS

Figure 1:
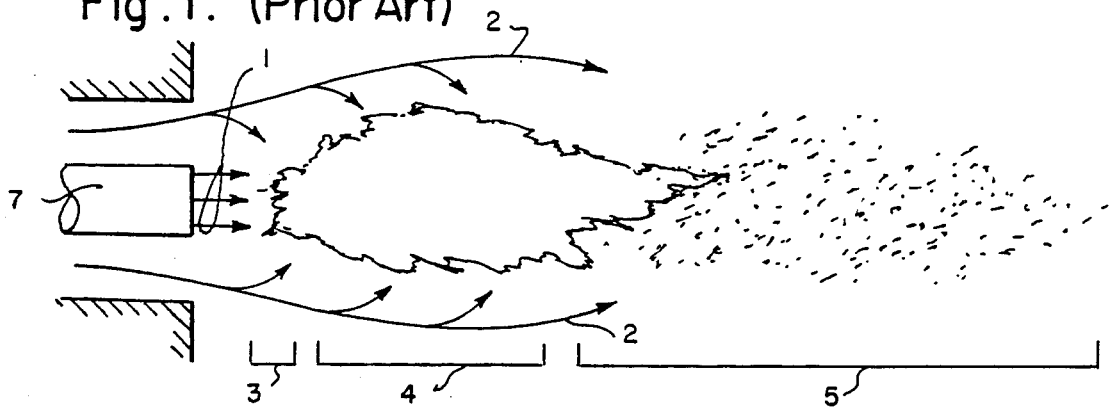
Fig. 1. (Prior Art)
FIG. 1 is a simplified diagram of a pulverized coal burner of the prior art.

Referring to FIG. 1, pulverized coal in a standard furnace is conveyed to the burners by the primary air stream 1. As the coal and primary air stream enter the furnace via the burner 7, heat from downstream combustion is transported by recirculated gases and radiation back to the incoming coal particles, igniting them at zone 3. Immediately following the ignition zone 3 of the burner is the primary flame zone 4, where the bulk of the secondary air 2 mixes with the fuel and burns. The primary flame zone is followed by a char burnout zone 5 in which the devolatilized coal particles are burned.

Figure 2:
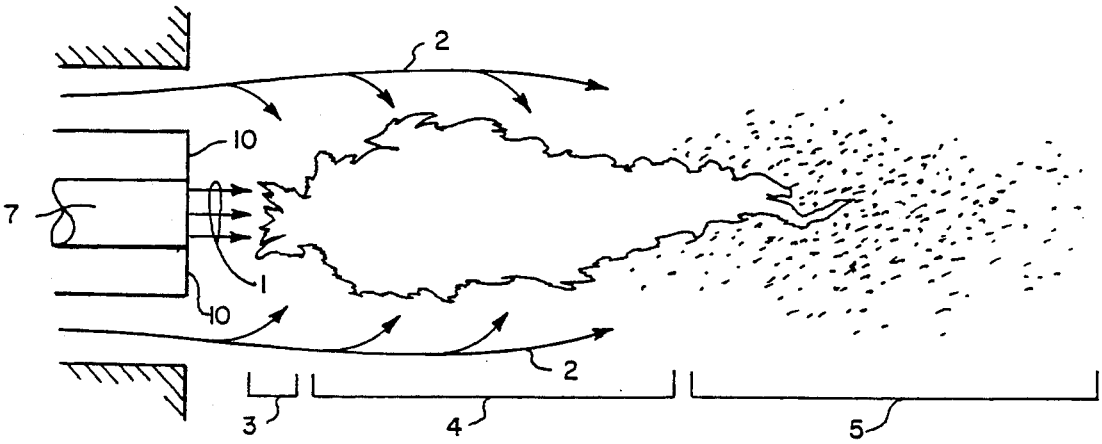
Fig. 2. (Prior Art)
FIG. 2 is a simplified diagram of a low-NOx pulverized coal burner of the prior art.

In FIG. 2, the burner is modified to achieve low-NOx emission. Here, like the standard furnace, pulverized coal and air in a low-NOx furnace are also conveyed to the burner through primary air stream 1. Secondary air 2 is introduced some distance defined by wall 10 from the primary air stream 1 to delay mixing with the primary air and coal in the primary flame zone 4, lowering the air/fuel ratio and lowering the NOx content of the emissions.

As stated above, coal with volatiles having a lower heat content are not generally utilized in a low-NOx furnace due to the difficulty of preserving ignition stability. The introduction of a gaseous or volatile liquid fuel into the ignition zone and/or the primary flame immediately downstream of the burner will have the same effect as increased quality and quantity of the volatile content of the coal. Any gaseous fuel with sufficient heat content or sufficiently volatile liquid fuel producing a vapor with sufficient heat content can be used in the invention. In order not to significantly affect the burner aerodynamics, gaseous or vaporized liquid fuels should preferably have heat contents of at least 500 Btu/ft$^3$, and liquid fuels should preferably volatilize virtually instantaneously relative to the burner time scale. The present preferred embodiment of the invention is intended to utilize a gaseous fuel or liquid fuel atomized to a Sauter mean diameter of 50 microns or less with such liquid fuel having a 90% distillation temperature of 350 degrees C. or less.

Figure 3:
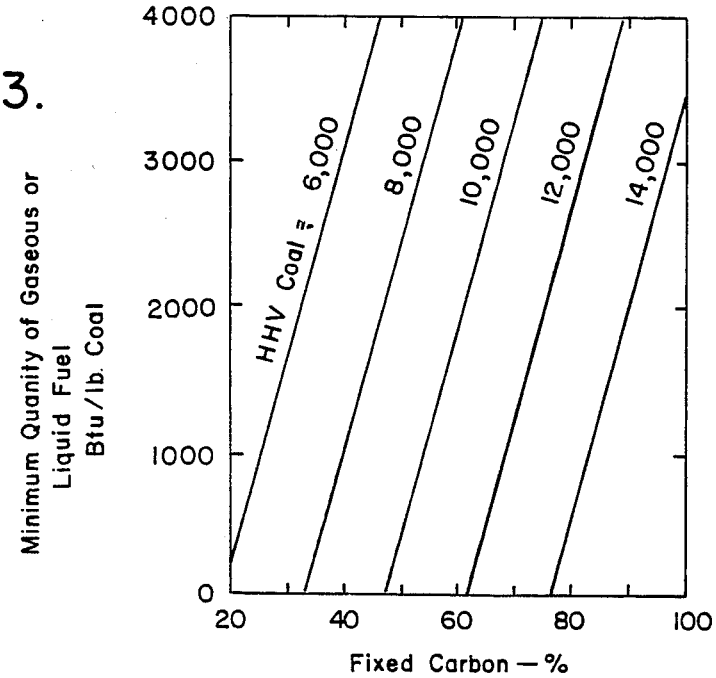
FIG. 3 is a chart of the minimum quantity of gaseous or liquid fuel required to stabilize or improve low-NOx burner performance on low-volatile coal.

The minimum quantity of fuel required for any coal will depend on the volatile heat content of the coal; i.e., the parameter $HHV_{vol}$ described above. Sufficient gaseous or liquid fuel should be added in any given case to at least increase the parameter $HHV_{vol}$ to 3400 Btu/lb based on the data presented above. FIG. 3 shows what we have discovered to be the minimum amount of gaseous or liquid fuel required per pound of coal as a function of coal heating value and fixed carbon content calculated on the basis of Equation 1. The minimum quantity of fuel shown in FIG. 3 is that required to stabilize the burner or pull back a lifted flame.

The graph of FIG. 3 is calculated by the following equations:

| $HHV_{coal}$, BTU/lbs | Minimum Energy of Fuel, BTU/lbs |
|---|---|
| 6000 | 138 (percent of fixed Carbon of coal) - 2550 |
| 8000 | 138 (percent of fixed Carbon of coal) - 4400 |
| 10000 | 138 (percent of fixed Carbon of coal) - 6550 |
| 12000 | 138 (percent of fixed Carbon of coal) - 8500 |
| 14000 | 138 (percent of fixed Carbon of coal) - 10700 |

More gaseous or liquid fuel may be added than the minimum requirement to reduce the air/fuel ratio in the primary flame and thus reduce NOx formation.

The gaseous or liquid fuel should be introduced into the ignition zone and/or the primary flame. Preferred methods would therefore be to introduce the gaseous or liquid fuel into the primary air via injectors placed upstream of the burner or into the primary air and/or secondary air via injectors located at the burner exit plane. In the case of injection to the secondary air, the injectors could be located slightly upstream of the burner exit plane. In the case of injection into the primary air stream, the fuel could impinge directly on the air stream within three feet of the burner exit. Alternately fuels could be injected into the primary air/coal stream at any point from the pulverizer to the burner.

Figure 6:
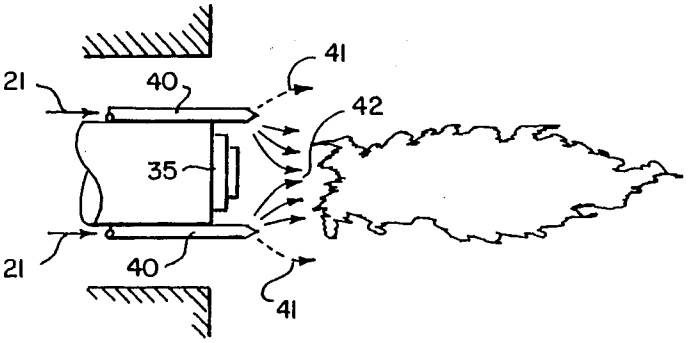
FIGS. 4 through 7 are simplified diagrams of a pulverized coal furnace showing alternative methods to inject gaseous or liquid fuels according to the present invention.
Figure 7:
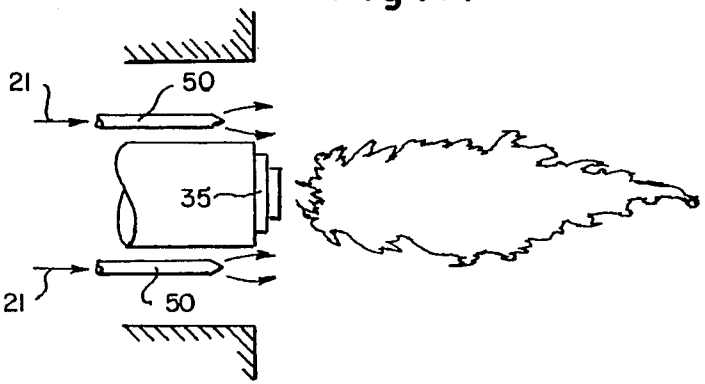
Figure 4:
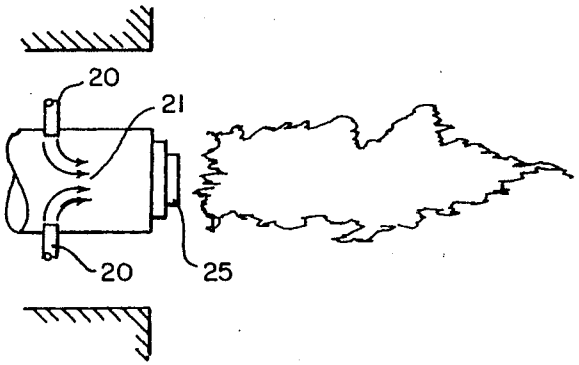
Figure 5:
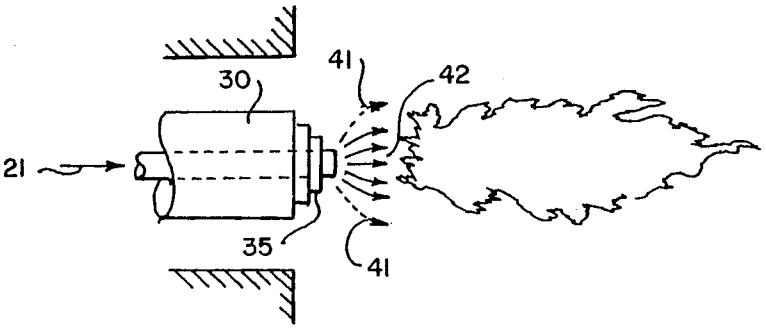

In injecting the gaseous or liquid fuel into either the primary air or secondary air, the injectors would be designed (i.e., number, size, shape, locations, orientations, and fuel pressure) to achieve rapid dispersion of the fuel into the air stream within the air travel distance available prior to encountering the ignition zone or primary flame. Possible injection locations are shown in FIGS. 4 through 7. In some embodiments, the flammable fuel is injected so as to impinge upon the primary air stream at a distance of three feet or less from the burner as in FIG. 5. Other embodiments, such as FIG. 6, intend the fuel to be introduced into the primary air stream at a distance of greater than three feet. In FIG. 4, the gaseous or liquid fuel 21 is injected through nozzles 20 into the primary air/coal stream upstream of the burner 25. In FIG. 5, the gaseous or liquid fuel 21 is injected at the center of the burner at its exit plane 35 using a mixing nozzle 30. In FIG. 6, the gaseous or liquid fuel 21 is injected via spuds or nozzles 40 arranged around the periphery of the primary air pipe at the burner exit plane 35. In FIG. 7, the gaseous or liquid fuel 21 is injected via nozzles 50 into the portion of the secondary air that is nearest the center of the burner. In many low-NOx burners, the secondary air is separated into inner secondary air 42 and outer secondary air 41, and in those cases the device shown in FIG. 6 could be used to inject the fuel only into the inner secondary air 42 (solid arrows). As indicated by the broken lines on the figure, the center injector or peripheral injectors in FIGS. 5 and 6, respectively, could be used to inject the gaseous or liquid fuel into the inner secondary air as well as into the primary air.

The methods described above to inject gaseous or liquid fuels for stabilization and improvement of low-NOx burner performance can also be applied to conventional pulverized coal burners. Present practice is to fire ignitor torches, present on the burners, to stabilize ignition of low-volatile coals. However, the methods described above may accomplish flame stabilization with the use of less fuel than is required to operate the ignitor torches, and reduce nitrogen oxide formation as well.

While we have described a present preferred embodiment of the invention, it is to be distinctly understood that the invention is not limited thereto but may be otherwise embodied and practiced within the scope of the following claims.

We claim:

1. An improved combustion method for reducing NOx emissions from a coal burner of the type having an ignition zone and a primary flame, where pulverized coal having volatile matter which is low in heat content is injected into one of the ignition zone and primary flame zone, wherein the improvement comprises the addition of flammable fuels, other than coal, into one of the ignition zone and primary flame, the energy introduced by the flammable fuel is less than:

$$138\ (\text{percent of fixed carbon in the coal}) + 3500 - HHV_{coal},$$

where $HHV_{coal}$ is the higher heating valve of the coal, in BTU per pound, to facilitate stable ignition and prevent flame lift-off.

2. A method as described in claim 1 wherein the coal burner is of the low-NOx type.

3. A method as described in claim 1 wherein the addition of flammable fuel lowers the air/fuel ratio and thereby reduces NOx emissions.

4. A method as described in claim 1 wherein the flammable fuel is a gas.

5. A method as described in claim 4 wherein the gaseous fuel is natural gas.

6. A method as described in claim 1 wherein the flammable fuel is a liquid.

7. A method as described in claim 6 wherein the liquid fuel is a petroleum product.

8. A method as described in claim 1 utilizing a coal burner having primary and secondary air streams, wherein the flammable fuel is added to the secondary air stream.

9. A method as described in claim 1 utilizing a coal burner having primary and secondary air streams, wherein the flammable fuel is added to the primary air stream.

10. A method as described in claim 1 utilizing a coal burner having primary and secondary air streams, wherein the flammable fuel is caused to impinge directly on the primary air stream within three feet of a point where the pulverized coal enters the burner.

11. A method as described in claim 1 utilizing a coal burner having primary and secondary air streams, wherein the flammable fuel is introduced into the primary air stream at a distance of equal to or greater than three feet from the burner.

12. A method as described in claim 1 wherein the flammable fuel is introduced into the primary air/coal stream near the pulverizer exit.

13. A method as described in claim 1 wherein the flammable fuel is introduced into the primary air/coal flow before the flow is broken into the individual burner streams.

14. A method as described in claim 1 wherein the coal has approximately 6000 BTU/lb and the flammable fuel supplies substantially not less energy than 138(percent of fixed Carbon of coal)−2550.

15. A method as described in claim 1 wherein the coal has approximately 8000 BTU/lb and the flammable fuel supplies substantially not less energy than 138(percent of fixed Carbon of coal)−4400.

16. A method as described in claim 1 wherein the coal has approximately 10,000 BTU/lb and the flammable fuel supplies substantially not less energy than 138(percent of fixed Carbon of coal)−6550.

17. A method as described in claim 1 wherein the coal has approximately 12,000 BTU/lb and the flammable fuel supplies substantially not less energy than 138(percent of fixed Carbon of coal)−8500.

18. A method as described in claim 1 wherein the coal has approximately 14,000 BTU/lb and the flammable fuel supplies substantially not less energy than 138(percent of fixed Carbon of coal)−10700.

* * * * *